US005185963A

United States Patent [19]

De brey

[11] Patent Number: 5,185,963

[45] Date of Patent: Feb. 16, 1993

[54] PIVOTAL ARM BELT LOADING DEVICE

[75] Inventor: Robert J. De brey, Edina, Minn.

[73] Assignee: Timesavers, Inc., Minneapolis, Minn.

[21] Appl. No.: 865,356

[22] Filed: Apr. 8, 1992

[51] Int. Cl.[5] ..... B24B 21/20

[52] U.S. Cl. ..... 51/148; 51/357; 51/170 EB

[58] Field of Search ..... 51/135 R, 135 BT, 148, 51/357, 170 EB, 141; 198/807, 813, 861.1; 474/144, 273

[56] References Cited

U.S. PATENT DOCUMENTS

| | | | |
|---|---|---|---|
| 3,127,712 | 4/1964 | Krogen | 51/148 |
| 3,134,206 | 5/1964 | Olton | 51/142 |
| 3,354,588 | 11/1967 | Roehrig | 51/141 |
| 3,777,442 | 12/1973 | Bernu | 51/141 |
| 3,896,592 | 7/1975 | Wintz | 51/135 R |
| 4,205,490 | 6/1980 | Evans | 51/135 R |

*Primary Examiner*—Bruce M. Kisliuk
*Assistant Examiner*—Bo Bounkong
*Attorney, Agent, or Firm*—Haugen and Nikolai

[57] ABSTRACT

A belt loading assist apparatus for use in combination with wide abrasive machines wherein the belt loading assist apparatus comprises a generally inverted "U"-shaped support arm which is arranged to be pivotally moved between operative and retracted dispositions. The axis of the support arm is generally coincidental with the axis of the upper guide drum and the support arm has an upper arcuate surface which is substantially coincidental with an outward projection of the surface of the upper guide drum. A support cylinder is provided for releasably retaining the support arm in its operative disposition.

3 Claims, 1 Drawing Sheet

PIVOTAL ARM BELT LOADING DEVICE

BACKGROUND OF THE INVENTION

The present invention relates generally to an apparatus for use in combination with wide abrasive belts utilized in abrasive surface treating machines, and more particularly to a belt loading assist means which is secured to the frame of the apparatus and provides support for the belt while it is in the process of being loaded onto the abrasive machine.

Wide abrasive belts are utilized for a variety of applications, such as, for example, surface abrading equipment for treatment of metallic, wood, or other articles. These belts are coated with abrasives and are normally driven along an orbit while traveling over two or more guide drums. The guide rolls or drums, include both driven drums and idler drums. Three such drums are typically utilized in platen head abrasive machines, with the guide drums being arranged along a configuration resembling that of a bilateral triangle. Three-drum arrangements are also utilized in certain systems wherein a tension and tracking roll may be employed with two other operative rolls or drums. In a platen head arrangement, for example, the platen is disposed between a pair of spaced apart lower guide rolls or drums, with a third such drum being arranged at an elevated upper apex point. One such platen head arrangement is illustrated in detail in U.S. Pat. No. 4,651,474, the disclosure of which is incorporated herein by reference. An example of a three-roll drum head system is illustrated in detail in U.S. Pat. No. 4,187,645, the disclosure of which is also incorporated herein by reference.

It is well known in the industry that the loading of wide abrasive belts on abrading equipment is a difficult, time-consuming, and frequently troublesome task. Belts are cumbersome, and because of their required durability, they are loaded only with frequent occurrences of difficulty. The problems involved in the belt loading operation are further aggravated due to the normal height or elevation of the upper guide roll. In other words, it is sometimes necessary for the operator to be positioned on a ladder or other elevating device in order to be able to appropriately maneuver the belt into position on the guide rolls. In recognition of the belt loading problems, devices for handling abrasive belts have been proposed in the past, however these devices are frequently large, cumbersome, and utilized as stand-alone attachments. When problems develop in the belt loading operation, creases or even tears may be created in the belt, including the abrasive and fabric portions, and when sufficiently severe, may destroy the belt for its intended purpose.

SUMMARY OF THE INVENTION

In accordance with the present invention, an improved belt loading assist device is provided, with the device including a body having a generally inverted "U"-shaped portion, and being pivotally mounted to the frame at a point adjacent the guide rolls or drums. The assist means is in the form of an arm member which is arranged for pivotal motion between a first operative and a second retracted disposition. In the operative disposition, the upper surface of the drum is arranged generally parallel with an axial projection of the upper guide drum, and hence provides a means for conveniently supporting the belt at a point where the operator can manipulate and otherwise appropriately slide the belt into position on the guide drums. Typically, the inverted "U"-shaped arm will have an axial length which is sufficient to provide at least partial support for the belt so as to enable the operator to expeditiously manipulate and maneuver the belt into position during the loading operation. The inverted "U"-shaped arm is stably held within its operative and retracted dispositions by means of mechanically biased struts which operate on an over-center basis to maintain the support arm in its desired or predetermined disposition. Such an arrangement may provide added rigidity for the support arm.

Therefore, it is a primary object of the present invention to provide an improved belt loading assist means for use in combination with wide belt abrasive surface treating apparatus, with the belt loading assist means providing a support arm for belts which are being loaded into operative position on the guide drums of the apparatus.

It is yet a further object of the present invention to provide an improved belt loading assist means for use in combination with wide belt abrasive machines, with the belt loading assist means comprising a generally inverted "U"-shaped support arm which may be conveniently and readily placed into an operative disposition to provide support for a wide abrasive belt during a belt loading operation.

Other and further objects of the present invention will become apparent to those skilled in the art upon a study of the following specification, appended claims, and accompanying drawing.

IN THE DRAWINGS

FIG. 1 is a perspective view of the belt loading assist means, and illustrating, in solid lines, the arrangement of the device in its operative disposition, and also illustrating, in phantom, its retracted disposition;

FIG. 2 is an end elevational view, partially broken away, and illustrating an arrangement of three guide drums in a wide belt abrasive machine with a platen head arrangement and further illustrating an end view of the belt loading assist means of the present invention coupled to the wide belt abrasive apparatus; and FIG. 3 is a side elevational view of the belt loading assist means of the present invention arranged in its operative disposition, and showing, in phantom, a belt in operative disposition on the support arm of the belt loading assist means, and further showing, in phantom, the belt loading assist means in retracted disposition.

DESCRIPTION OF THE PREFERRED EMBODIMENT

Figure 1:
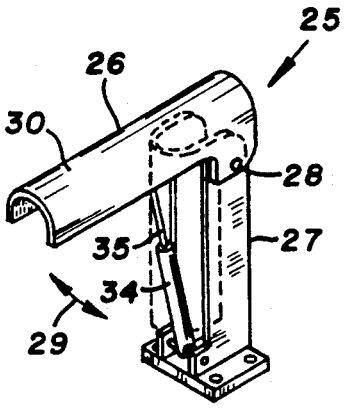
Figure 2:
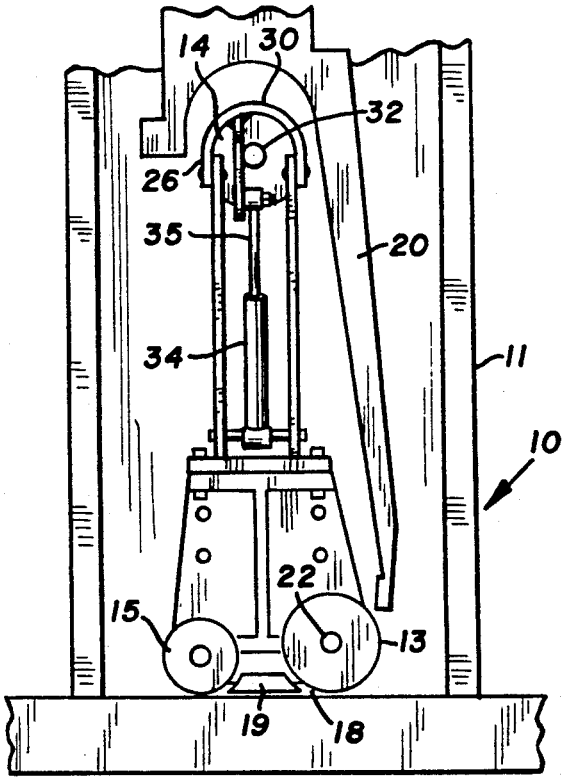

With reference to the drawings, the apparatus for driving and guiding wide abrasive belts shown generally at 10 includes frame means 11 for supporting a plurality of guide rolls or drums, including drums 13, 14 and 15. The drums are mounted for rotation, as is typical in these devices, within the frame means, and are disposed and otherwise arranged to define a predetermined path for an abrasive belt trained thereover, such as belt 16 (see FIG. 3). As is indicated, belt 16 is a typical wide abrasive belt, with such belts having dimensions in the range of, for example, up to 36 inches, 48 inches, or even greater widths. Workpieces are arranged to travel along a conveyor (not shown) and thereupon travel to a point within a working zone as at 18 positioned beneath guide drums 13 and 15. A platen head is typically interposed between the lower guide drums, with such a platen being illustratively shown at 19. In order to reduce the presence of dust in the ambient, dust collecting hood 20 is provided adjacent belt 16, with the details of dust collector 20 being illustrated in U.S. Pat. No. 4,525,955, the substance of which is also incorporated by reference herein.

As shown, belt 16 is trained about the outer surfaces of guide drums 13, 14 and 15, with the periphery or outer surface of drum 14 defining an elevated upper apex point for the belt 16. As is appreciated, at least one of the drums 13, 14 or 15 is driven, and thereby provides the motion required for moving belt 16 along and through its orbit. Typical drive mechanisms and other details of the abrading apparatus are illustrated in U.S. Pat. No. 4,512,110, also incorporated herein by reference.

In order to appropriately provide for rotation of drums 13, 14 and 15 within frame means 11, appropriate journals are provided as at 21-21 and 22-22, for example, and with a drive pulley being illustrated as at 23 for providing rotary motion to guide roll or drum 13.

Figure 3:
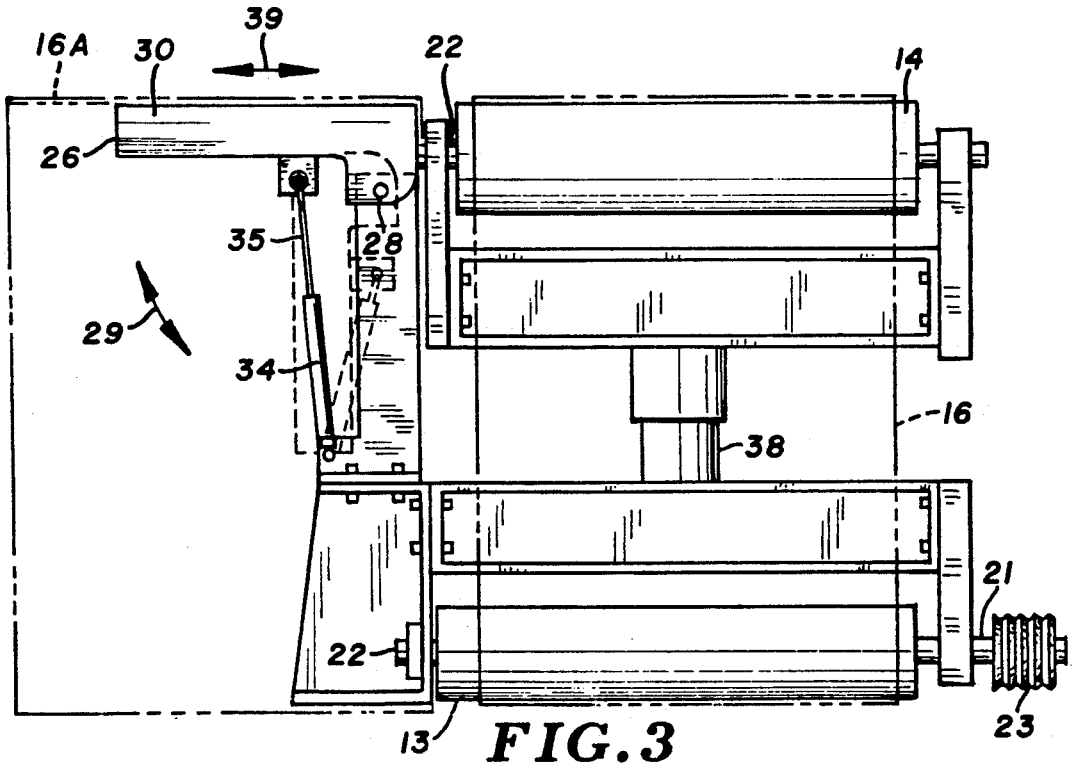

With attention now being directed to FIG. 1 of the drawings, the belt loading assist means shown generally at 25 includes a body having a generally inverted "U"-shaped support arm portion as illustrated at 26, and being pivotally mounted to the frame means 11 by means of upright support brackets as shown at 27. Support arm 26 is mounted for pivotal rotation about pin 28, with pivotal motion being achieved between pivotally spaced apart an operative disposition as shown in solid lines in FIGS. 1 and 3, and to a retracted disposition as shown in phantom in FIGS. 1 and 3. Double-ended arrow 29 shows the path of travel of arm 26. The support arm 26 is provided with an arcuately curved upper surface portion shown at 30 which is arranged radially outwardly of and which is substantially coincidental with the axis 32 of upper guide drum 14. The arcuately curved upper surface portion as illustrated at 30 is shown as a continuous surface, however it will be appreciated that an arcuate surface comprising a plurality of individual rods and/or tubes may be employed to form the arcuately curved upper surface portion. Furthermore, the upper arcuate surface 30 of arm 26 is substantially coincidental with an outward projection of the surface of upper guide drum 14. Thus, the operator may load the belt, such as belt 16, onto arm 26 and thereafter easily transfer and/or move the belt into operative disposition onto drums 13, 14 and 15 as shown in FIG. 3.

Means are provided for pivotally coupling arm 26 to support brackets 27. These means include gas filled strut 34, which provides a mechanical bias normally urging ram 35 to its extended disposition. This mechanical bias and extension of ram 35 provides a means for maintaining support arm 26 in either its operative or retracted disposition. The configuration of support arm 26 and strut 34 and ram 35 is shown in its retracted disposition in phantom in FIG. 3. It will be observed that the ram portion 35 of strut 34 is mounted so that it reaches a bottom-dead-center position while moving between its extended position and its retracted position. The overcenter operation of strut 34 and its ram 35 provides for bistable positioning of the device in both extended and retracted dispositions. Strut 34 is typically fabricated as a cylinder having a supply of compressed gas contained within the cylinder portion and with ram portion 35 being biased or extended outwardly under the force of the compressed gas. Such struts are, of course, commercially available, and are widely utilized in industrial and automotive applications.

In certain applications, and in order to assist in retention of support arm 26 in its extended operative disposition, a latch pin may be provided within bracket 27, for engagement with arm 26.

Therefore, in actual operation, when a belt change is indicated, the tension adjustment means shown at 38 is relaxed in order to provide slack in the used belt, whereupon the used belt may be readily removed from the apparatus along the direction of the left double-ended arrow 39. Thereafter, the new belt, such as belt 16A, is loaded onto support arm 26, and thereafter appropriately slid into position on guide drums 13, 14 and 15 to the right and along the direction of double-ended arrow 39. As is apparent from the drawings, the upper surface of support arm 26 is arranged in coplanar relationship with the surface of guide drum 14, with this coplanar relationship assisting in the smooth transition of the belt from the surface of support arm 26 onto the surface of guide drums, particularly guide drum 14. Upon completion of the belt loading and/or changing operation, support arm 26 is pivoted in a counter-clockwise direction from its operative disposition to its retracted disposition. This motion, as previously indicated, is shown at double-headed or double-ended arrow 29. The retracted disposition is illustrated in phantom in FIGS. 1 and 3.

It will be appreciated, of course, that the examples given herein are for purposes of illustration only, and are not to be otherwise construed as a limitation upon the scope of coverage to which the present invention is entitled.

What is claimed is:

1. In combination with an apparatus for driving and guiding a wide abrasive belt with abrading surface to treat surfaces of workpieces, with said apparatus including frame means, at least two guide drums, an upper and lower guide drums mounted about respective axes of rotation within said frame means for rotation and being disposed to define a predetermined path for said abrasive belt and for defining a work zone for functional contact between the surfaces of said wide abrasive belt and workpieces positioned within said work zone, with one of said guide drums being disposed above the plane of the other of said at least two guide drums, having parallel axes of rotation and defining an elevated upper apex point for said predetermined path; and an abrasive belt trained about outer surfaces of said guide drums; a belt loading assist means secured to said frame means and disposed adjacent said upper guide drum; said belt loading assist means being characterized in that:

(a) said belt loading assist means including a body having a generally inverted "U"-shaped support arm portion and being pivotally mounted to said frame means and arranged for pivotal motion between pivotally spaced apart operative and retracted dispositions;

(b) said support arm having an upper arcuate surface extending radially about a central axis with said support arm being positioned with said central axis aligned substantially coincidentally with the axis of rotation of said upper guide drum and having an upper arcuate surface substantially coincidental with an outward projection of the surface of said upper guide drum; and (c) means pivotally coupling said support arm to said frame means, and strut means providing a mechanical bias for maintaining said support arm in either of said operative or retracted dispositions.

2. The belt loading assist means as defined in claim 1 being particularly characterized in that said strut means are cylinders with mechanical bias being provided by a source of compressed gas.

3. The belt loading assist means as defined in claim 1 being particularly characterized in that latch means are provided for releasably holding said support arm in its operative disposition.

* * * * *